US010260198B2

(12) United States Patent
Verreet

(10) Patent No.: US 10,260,198 B2
(45) Date of Patent: Apr. 16, 2019

(54) METHOD FOR PRODUCING A WIRE CABLE

(71) Applicant: CASAR DRAHTSEILWERK SAAR GMBH, Kirkel (DE)

(72) Inventor: Roland Verreet, Aachen (DE)

(73) Assignee: CASAR DRAHTSEILWERK SAAR GMBH, Kirkel (DE)

( * ) Notice: Subject to any disclaimer, the term of this patent is extended or adjusted under 35 U.S.C. 154(b) by 437 days.

(21) Appl. No.: 15/051,397

(22) Filed: Feb. 23, 2016

(65) Prior Publication Data

US 2016/0194826 A1 Jul. 7, 2016

Related U.S. Application Data

(63) Continuation of application No. 10/547,992, filed as application No. PCT/EP2004/002516 on Mar. 11, 2004, now abandoned.

(30) Foreign Application Priority Data

Mar. 11, 2003 (DE) ..... 103 10 855

(51) Int. Cl.

| | |
|---|---|
| ***D07B 5/00*** | (2006.01) |
| ***D07B 1/06*** | (2006.01) |
| ***D07B 1/16*** | (2006.01) |
| ***D07B 7/16*** | (2006.01) |
| ***D07B 7/02*** | (2006.01) |

(52) U.S. Cl.

CPC ..... *D07B 5/005* (2013.01); *D07B 1/068* (2013.01); *D07B 1/0693* (2013.01); *D07B 1/16* (2013.01); *D07B 1/165* (2013.01); *D07B 5/007* (2013.01); *D07B 7/027* (2013.01); *D07B 7/16* (2013.01); *D07B 2201/1036* (2013.01); *D07B 2201/2074* (2013.01); *Y10T 428/2933* (2015.01)

(58) Field of Classification Search

CPC ..... D07B 1/068; D07B 1/0693; D07B 1/16; D07B 5/005; D07B 5/007; D07B 7/027; D07B 7/16

See application file for complete search history.

(56) References Cited

U.S. PATENT DOCUMENTS

| | | | |
|---|---|---|---|
| 2,156,652 | A | 5/1939 | Harris |
| 3,130,536 | A | 4/1964 | Peterson |

(Continued)

FOREIGN PATENT DOCUMENTS

| | | | |
|---|---|---|---|
| DE | 3723720 | A1 | 2/1988 |
| EP | 1001075 | A2 | 5/2000 |

*Primary Examiner* — Shaun R Hurley

(74) *Attorney, Agent, or Firm* — Lucas & Mercanti, LLP; Klaus P. Stoffel

(57) ABSTRACT

A method for producing a wire cable with a core cable or core strand, the method including the steps of: prior to stranding an outer strand layer, applying an intermediate layer of a plastic material to the core cable or core strand; pressing the outer layer into the plastic material during stranding; and, hammering the wire cable, after the outer strand layer has been stranded, to increase the space factor of the wire cable, wherein the hammering step includes hammering with hammers that are moved from different sides toward the wire cable and essentially completely surround the wire cable with adapted curvatures at the instant of their simultaneous impact.

9 Claims, 2 Drawing Sheets

(56) References Cited

U.S. PATENT DOCUMENTS

| | | | | | |
|---|---|---|---|---|---|
| 3,149,509 | A * | 9/1964 | Oquist | B21J 7/145 | 72/402 |
| 3,457,718 | A | 7/1969 | Otto | | |
| 3,705,489 | A | 12/1972 | Smollinger | | |
| 3,800,522 | A | 4/1974 | Hughes | | |
| 3,822,542 | A | 7/1974 | Naud | | |
| 4,120,145 | A | 10/1978 | Chiappetta | | |
| 4,270,341 | A | 6/1981 | Glushko | | |
| 4,318,290 | A * | 3/1982 | Anderson | D07B 7/16 | 29/517 |
| 4,454,708 | A * | 6/1984 | Verreet | D07B 1/0673 | 57/215 |
| 4,617,789 | A * | 10/1986 | Borden | D07B 3/06 | 29/599 |
| 4,645,718 | A * | 2/1987 | Dambre | C25D 5/48 | 152/451 |
| 4,778,246 | A | 10/1988 | Carroll | | |
| 5,075,952 | A * | 12/1991 | Pfaff | B29C 63/18 | 29/517 |
| 5,513,487 | A * | 5/1996 | Kumpf | D07B 3/005 | 57/294 |
| 6,078,010 | A | 6/2000 | Funahashi | | |
| 6,360,522 | B1 * | 3/2002 | Walton | D07B 1/167 | 57/200 |
| 6,385,957 | B2 | 5/2002 | Misrachi | | |
| 2003/0042456 | A1 * | 3/2003 | Makino | F02M 63/0019 | 251/129.16 |

* cited by examiner

METHOD FOR PRODUCING A WIRE CABLE

This application is a continuation of application Ser. No. 10/547,992, filed Jun. 13, 2006, which is a 371 of International Application PCT/EP2004/002516, filed Mar. 11, 2004, which claims the priority of DE 103 10 855.6, filed Mar. 11, 2003, the priority of all three applications is hereby claimed and all three applications are incorporated herein by reference.

BACKGROUND OF THE INVENTION

1. Field of the Invention

The invention concerns a method for producing a wire cable with a core cable or core strand, in which, after the outer strand layer has been stranded, the wire cable is hammered to smooth its surface and/or to increase its space factor.

2. Description of the Related Art

Wire cables of this type are well known for special applications in which a smooth surface of the wire cable is of prime importance, e.g., because they are dragged over the ground. An example of such applications is the lumber industry.

Without hammering, individual protruding wires would quickly break at the surface, which would lead to operational disruptions, increase the risk of accidents, and make the cable unusable. Notches in the cable produced by hammering and the internal wire breaks that soon occur as a result of this notching are accepted as a tradeoff.

SUMMARY OF THE INVENTION

The objective of the invention is to prevent wire damage caused by hammering to the greatest possible extent.

In accordance with the invention, this objective is achieved by applying an intermediate layer of a plastic material to the core cable or core strand before the outer layer of strands is stranded and by pressing the outer layer of strands into the plastic during the stranding process.

It was found that the support of the outer strands on the elastic plastic does not impair the hammering and the desired deformations. In a hammer works in which hammers adapted to the curvature of the surface of the cable strike simultaneously from different sides and essentially completely surround the surface of the cable at the instant of their simultaneous striking of the surface of the cable on an axial length of at least twice the cable diameter, the plastic apparently does not have enough time or space to escape from under the blow. The cavities between the outer layer of strands and the core cable or core strand are preferably filled with the plastic as far as the wedge-shaped spaces between the wires bounding these cavities.

Deformation of the outer strands occurs, more or less excluding those cross-sectional regions of the wire on the underside that are surrounded by the plastic and receive the counterpressure of the plastic everywhere perpendicular to their surface; they are thus not exposed to any deforming forces here. Directed forces, which deform the wires, occur on the upper side of these wires, which is not surrounded by plastic. Under these conditions, very strong deformation of the outer strands is possible. If the outer strands constitute a large portion of the cable diameter, reductions of the diameter of the wire cable of more than 10% can be achieved. A 5% reduction of the diameter can probably be achieved in most cases.

Deformation of the core cable or the core strand, the latter to a lesser extent, continues similarly towards the inside to a diminished extent but in the opposite way: Here, the outer wires remain essentially unchanged on the outside and are deformed on the inside, including the remaining strand cross section, such that the deformation more or less continues further into the interior of the cable.

Essentially no notches occur at intersecting wires of the core cable or the core strand, on the one hand, and of the outer strands, on the other hand.

The plastic intermediate layer does not really act as direct cushioning between these wires, but rather the conditions are comparable to a confined liquid, in which the pressure is exerted towards all sides, so that no significantly increased forces at all arise between the intersecting wires.

In accordance with the invention, it is possible to produce wire cables with an extraordinarily high metal cross section that have no internal damage and, in addition, have a very smooth surface.

It is also possible to produce a wire cable with great structural stability due to close denticulation of the outer strand layer with the core cable or the core strand by the elastic intermediate plastic layer and at the same time greater compression than is possible by other methods, such as compression of a core cable by rolling.

On the other hand, if it is desired that the denticulation be reduced, it is possible to use a core cable with smoothed outer strands or a smooth core strand.

The aforementioned compression of an outer strand layer on an elastic substrate made of plastic in accordance with the invention can also be realized in a wire cable with a core that consists exclusively of a plastic strand: here too, the wire cable can be hammered after the stranding of the strand layer, and thus the strand layer can be compressed and smoothed.

The wire cable receives a higher space factor and becomes resistant to surface wear, especially when running over rollers.

As a rule, standard strands with a core wire and only one wire layer or parallel-lay strands are used for the outer strand layer, since they have no wire intersections.

However, it is also possible to use strands with a readily deformable core, e.g., a core of soft iron or plastic.

As has already been hinted, it is advantageous to use preferably four hammers for the hammering, which are moved towards the wire cable from different sides and essentially completely surround it with adapted curvatures at the instant of their simultaneous impact.

In addition, the hammers should have an axial extent of at least twice the cable diameter and preferably should have an expanded, tapering inlet.

If there should be a need for it, after it has been hammered, a wire cable of the invention could additionally be subjected to a surface treatment or coated or provided with a sheath.

The wire cable can also serve as the core cable for the production of a wire cable, which then has, for example, an additional counterwound strand layer on the smooth surface.

DETAILED DESCRIPTION OF THE INVENTION

Figure 1:
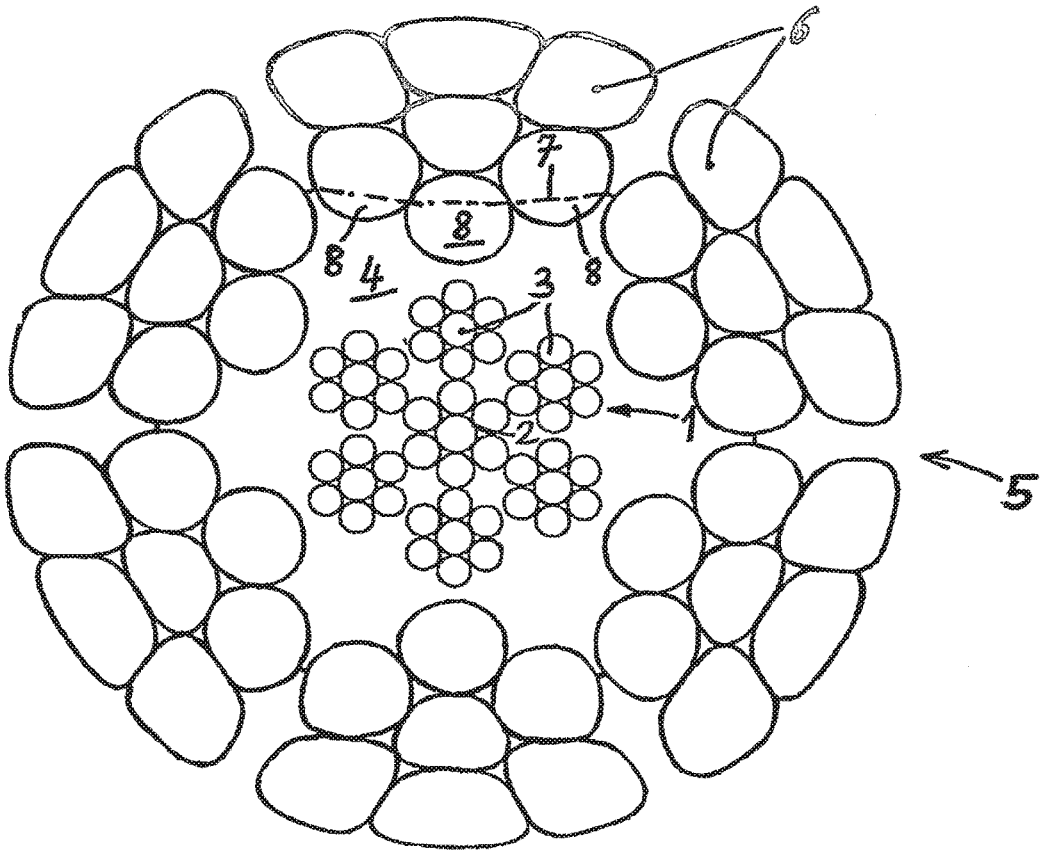
Fig. 1 is a cross-sectional drawing showing an embodiment of wire cable produced in accordance with the invention.

A core cable 1, which consists of a central core strand 2 (1+6) and six strands 3 (1+6), is surrounded by a thermoplastic 4.

During the stranding process on the core cable 1, an outer strand layer 5 that consists of six strands 6 (1+6) is pressed into the plastic 4, which has been softened by heating.

The wire cable produced in this way was hammered in the manner described above.

During this treatment, the outer strands 6 were strongly deformed. However, on their underside, the wire cross-sectional sections 8 that lie in the plastic 4, i.e., that lie below the dot-dash line 7, are largely preserved in their original form.

The core cable 1 was also somewhat deformed and compressed, but this occurred to only a slight extent in this case and is not shown in the drawing.

Figure 2:
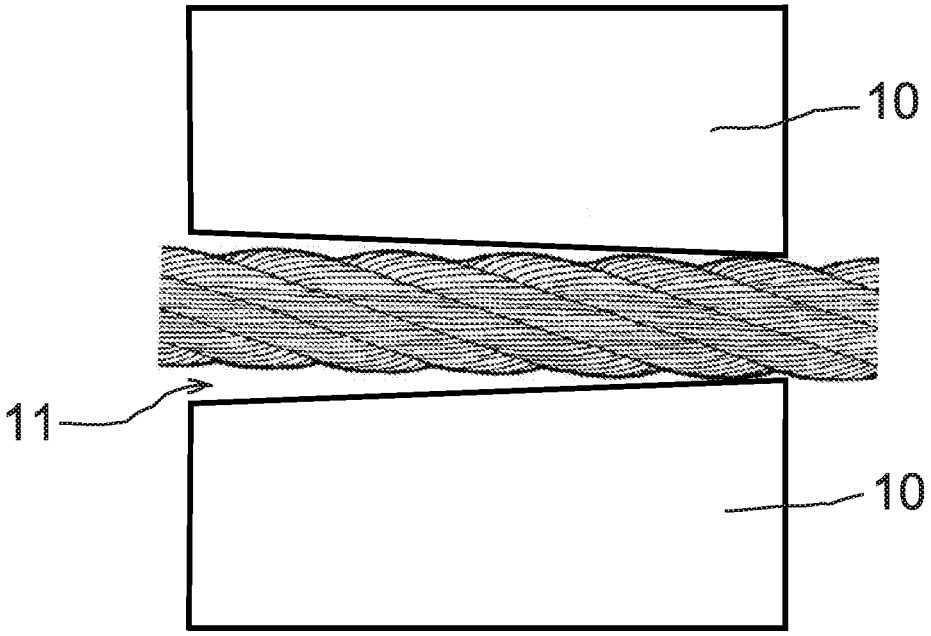
Fig. 2 schematically shows a wire rope and a cross-section of hammers having a tapering inlet.

Fig. 2 shows the wire rope and to hammers 10 in a cross-section along the axial extension of the wire rope. The inlet of the inlet 11 of the hammers 10 tapers.

The invention claimed is:

1. A method for producing a wire cable with a core cable or core strand, the method comprising the steps of: prior to stranding an outer strand layer, applying an intermediate layer: of a plastic material to the core cable or core strand; pressing the outer layer into the plastic material during stranding; and, hammering the wire cable, after the outer strand layer has been stranded, to increase the space factor of the wire cable, wherein the hammering step includes hammering with hammers that are moved from different sides toward the wire cable and completely surround the wire cable with adapted curvatures at the instant of their simultaneous impact, wherein hammers are used having an axial extension of at least twice the cable diameter and an enlarged, tapering inlet.

2. The method according to claim 1, wherein a thermoplastic material is used for the intermediate layer, further comprising heating the thermoplastic material during stranding of the outer strand layer.

3. The method according to claim 1, wherein strands with a core wire and a wire layer or parallel-lay strands are used for the outer strand layer.

4. The method according to claim 1, wherein strands with an deformable core are used for the outer strand layer.

5. The method according to claim 4, wherein the deformable core is of soft iron or plastic material.

6. The method according to claim 1, wherein four hammers are used for hammering.

7. The method according to claim 1, comprising subjecting the wire cable after hammering to a surface treatment.

8. The method according to claim 1, comprising coating the wire cable after hammering.

9. The method according to claim 1, comprising providing the wire cable with a sheathing.

* * * * *